United States Patent [19]

Fox, Jr.

[11] 4,253,722

[45] Mar. 3, 1981

[54] INSULATION PIERCE-TYPE CONNECTOR FOR RIBBON CABLE

[75] Inventor: Roy W. Fox, Jr., Pine Meadow, Conn.

[73] Assignee: Middleburg Corporation, Canton, Conn.

[21] Appl. No.: 42,358

[22] Filed: May 25, 1979

[51] Int. Cl.[3] ..... H01R 11/20; H01R 13/514; H01R 43/00

[52] U.S. Cl. ..... 339/99 R; 29/857; 339/176 MF

[58] Field of Search ..... 339/17 F, 176 MF, 99 R, 339/97 P, 97 C, 97 R, 98, 176 MP, 95, 103 M; 29/857, 861, 863, 865, 866

[56] References Cited

U.S. PATENT DOCUMENTS

| | | | |
|---|---|---|---|
| 3,820,055 | 6/1974 | Huffnagle | 339/17 F |
| 3,858,163 | 12/1974 | Goodman et al. | 339/176 MP |
| 3,964,816 | 6/1976 | Marozny | 339/99 R |
| 3,993,393 | 11/1976 | Worth | 339/99 R |
| 4,068,912 | 1/1978 | Hudson | 339/99 R |
| 4,094,572 | 6/1978 | Burr | 339/97 P |

*Primary Examiner*—John McQuade
*Assistant Examiner*—John S. Brown
*Attorney, Agent, or Firm*—Radford W. Luther

[57] ABSTRACT

A pierce-type connector for ribbon cable has a base and a mating cover joined together to clamp a multi-conductor flat flexible cable. The cover and the base have appropriately aligned cavities for accomodating contact elements. The contact elements are inserted through the top of the cover after the cable is clamped. The elements have insulation piercing slots so that each element may slice through the conductor insulation to electrically engage a conductor wire and are shaped so as to hold the base and cover in engagement after contact is achieved with the conductor wires. This construction facilitates manufacture and circuit continuity checks.

13 Claims, 15 Drawing Figures

10
12
14
16
18
20
22
24
26
28
30
32
34
36
38
40
42
44
45
46
2
3
4
6
7

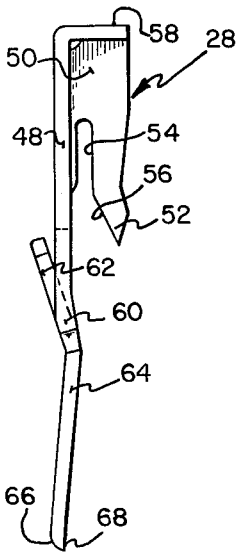
FIG. 11
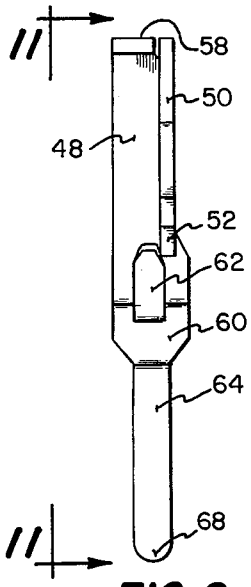
FIG. 9
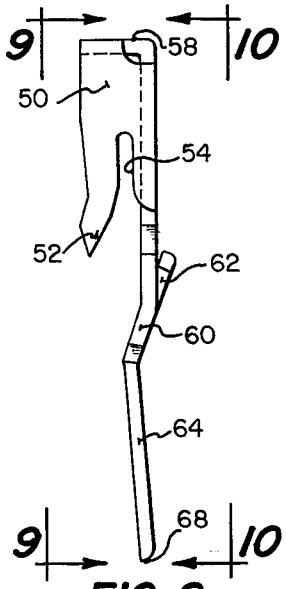
FIG. 8
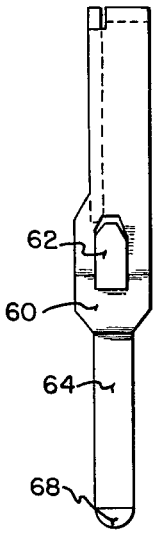
FIG. 10
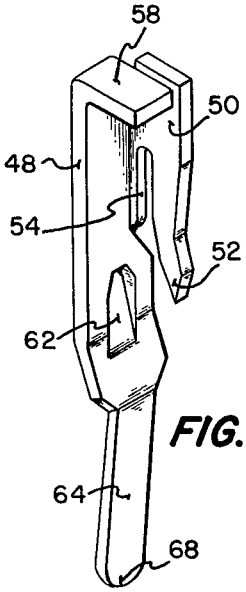
FIG. 12
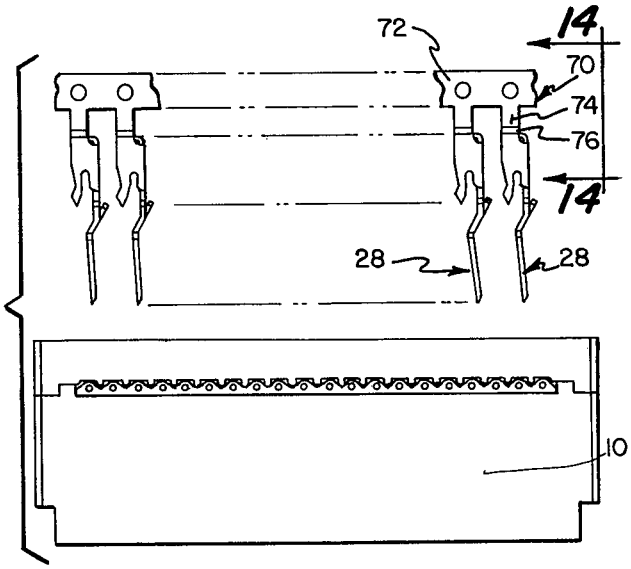
FIG. 13
FIG. 2A
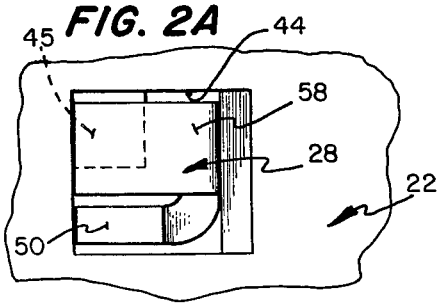
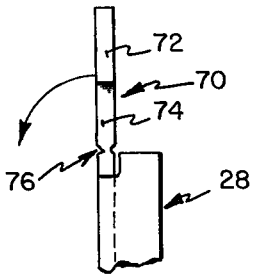
FIG. 14

INSULATION PIERCE-TYPE CONNECTOR FOR RIBBON CABLE

BACKGROUND OF THE INVENTION

1. The Field of the Invention

This invention relates to insulation piercing-type connectors for multi-conductor flat flexible cable.

2. Description of the Prior Art

Many different forms of insulation piercing-type connectors for the termination of flat-flexible cable are known in the prior art. A prevalent type of prior art connector embodies a base having mounted therein a plurality of forks with insulation displacing slots. The cable is secured to the base by attaching a cover which causes the forks to pierce the cable insulation and establish electrical contact.

A drawback in such a connector is that pulling on the cable may cause the conductors to move upwardly within the slots of the forks and impair the integrity of the electrical engagement. In addition, systems employing such connectors may require disconnecting intermediate sections in order to effect continuity tests. With regard to the assembly of the aforementioned type of connector, it is not possible to merely insert the contact elements after the cable is clamped in a complete connector assembly since they must be prepositioned in the base. Moreover, such connectors mandate the inclusion of some means to secure the cover to the base.

SUMMARY OF THE INVENTION

The invention provides a connector for terminating a multi-conductor flat flexible cable which is extremely simple in construction and a method of making the connector wherein, as a final step, the contact elements are, either jointly or severally, driven downwardly through the cover and cable into the base in latching engagement with the latter.

A connector of the invention comprises a base and a mating cover with a flat flexible cable clamped therebetween. A plurality of contact elements, having inverted conductor engaging slots, extend between the cover and the base. The contact elements and the cavities in the base and cover through which the elements extend are formed so that the contact elements function to hold the cover and base in engagement. During assembly of the connector, the cover and the base are pressed together with the cable therebetween. The contact elements are then driven downwardly through the top of the cover so as to pierce the insulation and eventually establish a latching engagement with the base.

A connector of the invention offers certain advantages. Because of the inverted slots, the conductors will not tend to move away from the top or apex of the slot upon a pulling of the cable. Also, no means are required to secure the cover to the base since the contact elements themselves may perform that function. It is important to note that a connector of the invention has sufficient inherent strength whereby additional strain relief of the engagement is unnecessary. The cavities or openings in the cover through which the contact elements were inserted may hence be left open or unplugged such that circuit continuity may be readily tested (by contacting the tops of the elements) without disconnecting any intermediate sections of a circuit in which the connector is incorporated.

Accordingly, it is a primary object of the invention to provide a connector for a flat ribbon cable which is simple in construction and susceptible of easy manufacture.

Another object is to provide a connector for ribbon cable wherein the contact elements function to secure the components together.

A further object is to provide a connector for ribbon cable which facilitates the testing of circuit continuity.

A still further object is to provide a connector for ribbon cable terminals which is resistant to deterioration in electrical contact due to stresses placed upon the cable.

A still further object is to provide a method of making a connector for ribbon cable wherein the contact elements are inserted only after the cover and base are urged together with the cable clamped therebetween.

These and other objects and advantages of the invention will become more readily apparent from the following detailed description, when taken in conjunction with the accompanying drawings, in which:

BRIEF DESCRIPTION OF THE DRAWINGS

FIG. 2A is an enlarged top view of an area of the connector showing a contact element mounted in a cavity.

FIG. 5 is a fragmentary top view of the cover, per se, with the contact elements removed to illustrate the cavity geometry.

FIG. 8 is a front elevational view of a contact element, per se.

FIGS. 9 and 10 are side elevational views of the contact element of FIG. 8 as seen along the lines 9—9 and 10—10, respectively.

FIG. 11 is a rear elevational view of the contact element as seen along the line 11—11 of FIG. 9.

FIG. 12 is a perspective view of a contact element.

FIG. 13 is a front elevational view showing a strip of contact elements above the base and cover assembly prior to insertion therein.

FIG. 14 is an enlarged fragmentary side elevational view of the strip of FIG. 10, as seen along the line 14—14 of FIG. 13.

DETAILED DESCRIPTION OF PREFERRED EMBODIMENT

Figures 1, 2, 3, 4, 5, 6, 7:
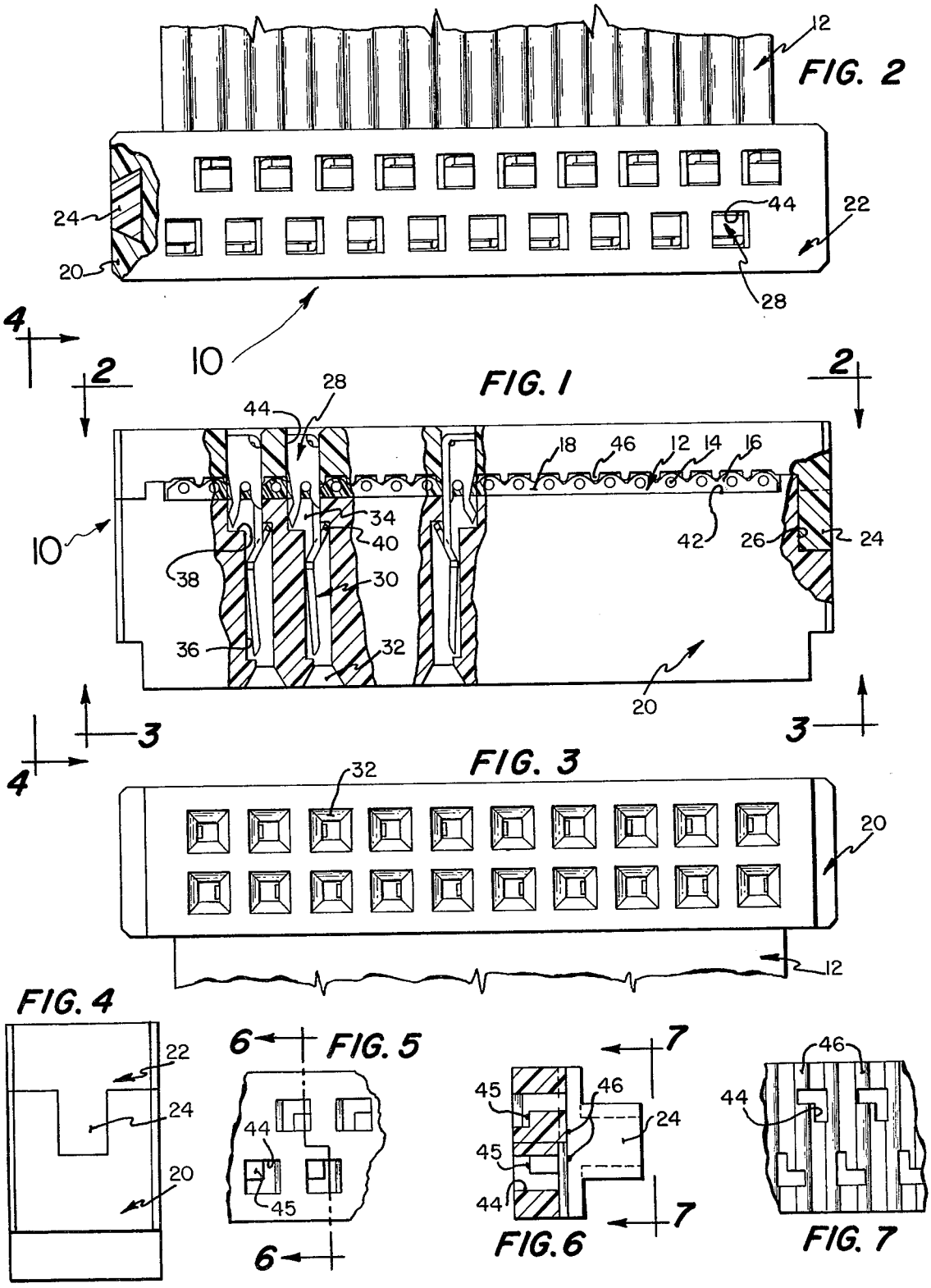
FIG. 1 is a front elevational view, partly in section, of a preferred form of connector according to the invention.
FIG. 2 is a top view of the connector of FIG. 1 as seen along the line 2—2 of FIG. 1.
FIG. 5 is a bottom view of the connector of FIG. 1 as seen along the line 3—3 of FIG. 1.
FIG. 4 is a side elevational view of the connector of FIG. 1 as seen along the line 4—4 of FIG. 1.
FIG. 6 is a sectional view of the cover as seen along the line 6—6 of FIG. 5.
FIG. 7 is a fragmentary bottom view of the cover as seen along the line 7—7 of FIG. 6.

Turning now to FIGS. 1, 2, 2A, 3 and 4, there is shown a connector 10 constructed in accordance with the concepts of the invention. The connector 10 is depicted as terminating a flat multi-conductor cable 12 of the type which includes a plurality of longitudinally extending parallel conductor wires 14. The conductor wires are held in this relationship by an insulation layer 16 of penetrable dielectric material (such as polyvinylchloride). The webs 18, formed between the conductor wires 14, should have at least a limited amount of resiliency which will allow for deformation of the cable.

The connector 10 comprises a base with an upper side and a lower side, generally indicated at 20, and a cover with an upper side and a lower side, generally indicated at 22 which are molded or otherwise formed of a plastic or other suitable insulating material. The upper side of the base 20 overlies one face from the upper side thereof to the lower side thereof of the flat insulated cable 12 and the mating cover 22 overlies the opposite face of the cable. The cover 22 has legs dovetailed 24 at its longitudinal extremities which are received in mating recesses 26 in the longitudinal extremities of the base 20. A plurality of contact elements 28 (described more fully hereinafter) are disposed within the connector 10 in respective mechanical and electrical connection with the several round conductor wires 14 of the cable 12 which is clamped between the cover 22 and the base 20. As is subsequently described, the base 20 and cover 22 are maintained in engagement by means of the contact elements.

The base 20 has formed therein two rows of juxtaposed vertical cavities 30 which extend completely therethrough. The lower ends of the cavities terminate in flared apertures 32 shaped to receive and guide respective pin contacts (not shown) or the like into mechanical and electrical engagement with the contact elements 28. Each cavity 30 is formed by an upper segment 34 and a laterally offset lower segment 36 which define horizontal surfaces 38 and 40. The base also comprises a rectangularly-shaped, transversely extending recess 42 adapted to receive the cable 12. The cavities 30 in the rear row are similar in shape to the cavities 30 in the front row but have their upper segments 34 laterally offset from the lower segments 36 in the opposite direction. As shown in FIG. 3, each lower segment 36 in the rear row is directly behind a lower segment in the front row. The reason for the lateral offset is to permit a 180° difference in orientation between the contact elements of the front and rear rows which permits the rectangular aperture array of FIG. 3.

The cover 22 has two longitudinal rows of cavities 44 with the cavities in one row in staggered relationship to the cavities of the other row. Each of the cavities 44, which extends completely through the cover 22, is in vertical alignment with an upper segment 34 of a cavity 30 in the base. As best shown in FIGS. 5, 6 and 7, each of the cavities is formed with a rectangular cross section in the upper part thereof and an L-shaped cross section in the lower part thereof whereby an engagement surface 45 is defined therein. The cover additionally incorporates a plurality of longitudinally spaced, transversely extending ribs 46 which overlie the webs 18 between the conductors to assure accurate spacing of the conductors 14 prior to engagement with the contact elements.

The contact elements 28 are typically formed as stampings from a relatively thin but suitably hard and durable conductive sheet metal and may be plated with gold or other acceptable plating material in the area of pin contact. In practice, the sheet metal may usually be a copper-nickel alloy (alloy 725 cupronickel) but beryllium copper phosphor bronze alloy and many other alloys would also be satisfactory. The thickness of the stamped contact element may vary as mandated by the gage of the conductor wire encased in the insulated cable and the contact spring and retention for applications beyond the usual small gage signal cables.

The geometry of the contact element 28 may best be appreciated by reference to FIGS. 2A and 9–12. The contact element 28 has a generally L-shaped upper section comprising a lower leg 48 having at one of its sides a side wall part or flange 50 which is formed to define an insulation piercing tine 52 with an insulation piercing point and a slot 54 which has a rounded apex or bottom and is beveled at its entrance 56 to facilitate wire receiving. As is well-known in the art, such slots are dimensioned to the conductor wire so that optimum electrical contact is achieved therebetween. The L-shaped section also comprises an upper leg or overlying portion 58 which may be considered as a roof or bridge which remains exposed in the assembled connector to facilitate periodic continuity checks. The portion 58 also is disposed above the engagement surface or ledge 45, in the cover which prevents upward removal of the cover from an assembled connector. It will be noted that the lower leg 48, the upper leg 58, and the side wall part 50 are disposed in a mutually perpendicular relationship.

An intermediate section 60 of the element 28 is bent out of coplanar relationship to the contiguous depending portion of the L-shaped leg section 48. As shown in FIGS. 6 and 7, the lower part of the intermediate section 60 may taper to a reduced width. In order to prevent upward movement of the contact element 28, an abutment in the form of a tab 62 is fashioned by notching the upper part of the intermediate section and the lower part of the upper section.

The contact element 28 terminates in a lower section defined by contact arm 64 which is outwardly bent and depends from the intermediate section at an angle thereto. The width of the contact arm 64 is dictated by the desired spring characteristics. The lower surface area 66 is preferably, but not necessarily, gold plated to insure excellent electrical contact with a terminal pin or the like of a further connector (not shown). The lower end of the contact arm 64 has an insulation piercing tip 68 which is adjacent an aperture and is the first area of the contact element 28 to contact the insulation when it is inserted into the connector.

In an assembled connector, the undersurface of the overlying portion 58 engages the surface 45 and the tab 62 engages the surface 40. This engagement serves to lock the cover on the base, thereby obviating the provision of other attaching means.

The first step in assembling a connector of the invention is to place the cable 12 between the base 20 and cover 22 with its end flush, slightly recessed or extending substantially from the front of the connector. Prior to the placement of the cable, the cable will have been cut square so that its end has exposed and accessible conductor wires for subsequent probing. Next, the base 20 and cover 22 are urged or clamped together in such a manner as to securely hold the cable in position. A preliminary continuity check may, if desired, then be effectuated. Finally, the contact elements 28 are inserted downwardly through the cavities 44 in the cover 22 and into their final resting positions.

During downward movement of a contact element 28 in the cavities 44 and 30, the tip 68 first cuts through the cable insulation 16. As the contact element 28 continues its downward travel, the point of tine 52 enters the insulation. Thereafter the conductor wire 14 is enveloped by the slot 54. As the contact element moves further downwardly, the tab 62 engages the wall of the cavity 44 (and subsequently, the wall of cavity segment 34) which produces a slight bending of the contact element 28. Because the contact element 28 is resilient, it will snap back to its original shape when the tab clears the wall of the cavity segment 34 whereby the surface 40 will be disposed above the tab 62 so as to prevent upward or return movement of the contact element 28. Downward travel of the contact element 28 is limited by engagement between the surface 45 and the undersurface of underlying portion 58. After insertion of the contact element 28, the cover becomes fixedly attached to the base and separation therebetween is prevented.

The contact elements may, of course, be produced as separate pieces and individually inserted into the connector. However, it is expedient to stamp out the contact elements in long strips from a single piece of sheet metal. A segment or portion of such a strip is illustrated in FIGS. 13 and 14 and designated generally by the numeral 70. The strip 70 comprises a carrier strip 72 having legs 74 and, of course, the contact elements 28 which appear to hang therefrom. The side wall part 50 of the upper section of the contact element 28 is in fact an extension of its associated leg 74. However, the leg 74 is notched adjacent the upper surface of the side of the side wall part 50 as indicated by the numeral 76, so that it can be broken away from the attached contact element 28.

With the cable properly clamped between the cover and the base, a segment of length of strip, which has the same number of contact elements as are in a row of cavities, is placed above the cover such that the contact elements are aligned with the respective cavities in the front row in which they are to be received. The contact elements, and hence the carrier strip 70, would be, of course, orientated in the opposite direction if the elements were to be inserted in the rear row. At this time, the carrier strip segment may or may not have been severed from the carrier strip proper. The carrier segment strip is then driven downwardly (by hand or a pressing tool) so the contact elements are latched into the connector as described heretofore. The carrier strip segment is then pushed forwardly or rearwardly with respect to the connector so as to cause the legs of the carrier strip segment to snap off the secured contact elements. The direction of motion to be imparted to the carrier is indicated by the arrow in FIG. 14.

For mass production of the heretofore described connector, the strips may be wound upon reels (e.g., with 30,000 contact elements in a single strip) and moved past a platten or similar device such that a segment of proper length is placed above the cover. The platten may then cut-off the segment from the strip and drive the contact elements into the connector cavities. Other mass production schemes could employ precut lengths of strips.

Obviously many modifications are possible in light of the above teachings without departing from the scope or spirit of the invention. For example, the contact element could embody an additional side wall part having a slot for establishing secondary contact with the conductor wire. Moreover, the L-shaped upper section could be replaced by a channel-shaped section or otherwise suitably formed section. Also, the tab could be dispensed with if the contact member is appropriately shaped so that it cannot be withdrawn from the base. In addition, it is important to note that, in a connector of the invention, the contact elements could be premolded in the cover. It will, however, be appreciated that the latter arrangement would not permit pre-positioning of the cable between the cover and the base and hence may not be as advantageous from a manufacturing standpoint.

I claim:

1. In an electrical connector of the type having a base with an upper side and a lower side, the base having a plurality of cavities extending through the base from the upper side thereof to the lower side thereof, the lower ends of the cavities in the base terminating in apertures shaped to receive contact pins, a cover with an upper side and a lower side, the cover having a plurality of cavities in alignment with the cavities in the base, an insulated multi-conductor wire flat cable clamped between the cover and the base such that the upper side of the base and the lower side of the cover respectively overlie the opposite sides of the cable, a plurality of insulation piercing contact elements mounted in the cavities such that the contact elements extend through the cable and are in respective electrical contact with the conductor wires, the improvement comprising:

each contact element having an upper section with at least one tine having an insulation piercing point adjacent the upper side of the base, the tine defining a conductor wire receiving slot having an apex on the side of the cable adjacent the cover and an entrance on the side of the cable adjacent the base, each contact element further having a lower section including at least one contact arm with an insulation piercing tip extending into the base such that it is adapted to engage a contact pin and its tip is adjacent an aperture, each contact element further having an abutment adapted to engage a surface of the base to prevent movement of the contact element out of the base.

2. The improvement of claim 1, further comprising: the cavities in the cover extending completely therethrough so as to expose the tops of the contact elements and facilitate continuity checks.

3. The improvement of claim 1, wherein each contact element has an intermediate section and wherein the abutment comprises a tab extending therefrom.

4. The improvement of claim 1, further comprising a surface on the contact element adapted to overlie a surface on the cover to prevent withdrawal of the cover away from the cable and the base.

5. In a method of making an electrical connector which comprises a cover, a base having a plurality of apertures for receiving contact pins, an insulated multi-conductor wire flat cable clamped between the cover and the base and a plurality of contact elements, having contact arms for engaging the contact pins, mounted in the base and cover such that the contact elements extend through the cable and are in respective electrical contact with the conductor wires, the sequential steps comprising:

clamping the cable between the cover and the base;

positioning a contact element above the cover;

inserting the contact element downwardly through the cover;

initially piercing the cable with the lower end of the contact element; and again piercing the cable with an upper portion of the contact element spaced from the lower end thereof to establish electrical contact with a conductor wire.

6. The method of claim 5, wherein the cable is initially pierced with the contact arm of the contact element and further comprising the step of:

locking the contact element into the base after electrical contact with a conductor wire is established.

7. The method of claim 6, further comprising the step of:

securing the cover and the base together as the contact element is locked into the base.

8. A one-piece contact element for a pierce-type electrical connector comprising:

an inverted L-shaped upper section having an upper leg and a lower leg depending therefrom, a side wall part connected to the side of the lower leg and extending therefrom such that the upper leg, the lower leg and the side wall part are mutually perpendicular, the side wall part being formed to define an insulation piercing tine and an adjacent wire receiving slot, the apex of the slot lying above the entrance of the slot;

a lower section comprising a contact arm, with an insulation piercing tip, for engaging a pin; and a tab extending outwardly of the contact element for locking the contact element in the connector.

9. A stamped assembly of contact elements for use in making pierce-type electrical connectors comprising:

an elongated carrier strip;

a plurality of spaced legs depending from the strip in perpendicular relationship thereto;

a plurality of contact elements respectively attached to the legs, the legs having notches at their respective locations of attachment to the contact elements so that the carrier strip and the legs may be broken away from the contact elements after they are fixedly mounted in a connector, each contact element comprising an upper section having a side wall part defining an insulation piercing tine and an adjacent wire receiving slot, the apex to the slot lying above the entrance to the slot, the side wall part being an extension of its associated leg and the notch thereof extending transverse to the axis of the leg; and a lower section comprising a contact arm having an insulation piercing tip.

10. A stamped assembly, as defined in claim 9, wherein each contact element further comprises:

a tab extending outwardly of the contact element for locking the contact element in a connector.

11. In a method of making a pierce-type connector for ribbon cable having a plurality of insulated conductor wires of the type which comprises the steps of providing a cover having at least one row of cavities, providing a base having at least one row of cavities which terminates in apertures adapted to receive leads, and clamping the cable between the cover and the base such that the cavities in the base are respectively aligned with the cavities in the cover, the improvement comprising:

providing a carrier strip segment having a number of spaced contact elements attached thereto which corresponds to the number of cavities in the said row in the cover;

positioning the carrier strip segment such that the contact elements thereof are generally aligned with the cavities in the cover and spaced therefrom;

moving the carrier strip segment toward the cover so as to cause the contact elements to enter the cavities in the cover, pierce the cable and enter the cavities in the base; and breaking off the carrier strip segment from the contact elements.

12. A one-piece contact element for a pierce-type electrical connector comprising:

an upper section having a time with an insulation piercing tip and an adjacent wire receiving slot, the apex of the slot lying above the entrance of the slot;

an intermediate section having a tab extending outwardly of the contact element for locking the contact element in the connector; and a lower section comprising a contact arm with an insulation piercing tip for engaging a pin.

13. A one-piece contact element, as defined in claim 12, wherein the upper section comprises:

a roof having a surface perpendicular to the axis of the slot for engaging a surface in the connector.

* * * * *